US006666179B2

(12) United States Patent
Sluka et al.

(10) Patent No.: US 6,666,179 B2
(45) Date of Patent: Dec. 23, 2003

(54) CAMSHAFT FOR THE OPERATION OF VALVES OF AN INTERNAL-COMBUSTION ENGINE

(75) Inventors: Gerold Sluka, Neckartailfingen (DE); Edwin Palesch, Lenningen (DE); Wolfgang Stephan, Boll (DE); Axel Willi Jochim, Nürtingen (DE); Andreas Knecht, Kusterdingen (DE)

(73) Assignees: Dr. Ing. h.c.F. Porsche AG, Stuttgart (DE); Hydraulik Ring GmbH, Limbach-Oberfrohna (DE)

( * ) Notice: Subject to any disclaimer, the term of this patent is extended or adjusted under 35 U.S.C. 154(b) by 32 days.

(21) Appl. No.: 09/900,492

(22) Filed: Jul. 9, 2001

(65) Prior Publication Data

US 2002/0029754 A1 Mar. 14, 2002

(30) Foreign Application Priority Data

Jul. 7, 2000 (DE) ..... 100 33 291

(51) Int. Cl.[7] ..... F01L 1/34
(52) U.S. Cl. ..... 123/90.17; 123/90.15
(58) Field of Search ..... 123/90.12, 90.15, 123/90.17, 90.31; 74/568 R; 464/1, 2, 160

(56) References Cited

U.S. PATENT DOCUMENTS 6,058,897 A * 5/2000 Nakayoshi ..... 123/90.17
6,260,524 B1 * 7/2001 Wachi ..... 123/90.15
6,302,072 B1 * 10/2001 Sekiya et al. ..... 123/90.17

FOREIGN PATENT DOCUMENTS

| | | |
|---|---|---|
| DE | 3937644 A1 | 5/1991 |
| DE | 19623818 A1 | 12/1996 |
| EP | 0 848 140 A1 | 6/1998 |
| JP | 11-2108 | 1/1999 |
| JP | 11-311109 | 11/1999 |
| JP | 11-343819 | 12/1999 |

* cited by examiner

*Primary Examiner*—Thomas Denion
*Assistant Examiner*—Jaime Corrihgan
(74) *Attorney, Agent, or Firm*—Crowell & Moring LLP

(57) ABSTRACT

A camshaft includes a device for hydraulic adjustment of a relative rotating position of the camshaft for the purpose of influencing valve timing. The device has a drive wheel, a cell wheel, and an impeller. The impeller is disposed by way of vanes within cells of the cell wheel and can carry out relative motion. A locking arrangement, which operates in the starting phase of the internal-combustion engine, is provided between the cell wheel and the impeller. The locking arrangement is formed by an axially spring-loaded, hydraulically operated piston housed in one of the vanes of the impeller and by a corresponding receiving device for the piston provided in a constructional unit consisting of the drive wheel and the cell wheel. The piston, which projects by way of a locking section into the receiving device and is guided in the vane, cooperates with an operating element for optimizing the locking arrangement. The piston is acted upon from a first pressure space, and the operating element is acted upon from second pressure space.

11 Claims, 2 Drawing Sheets

CAMSHAFT FOR THE OPERATION OF VALVES OF AN INTERNAL-COMBUSTION ENGINE

This application claims the priority of German application 100 33 291.9, filed Jul. 7, 2000, the disclosure of which is expressly incorporated by reference herein.

BACKGROUND AND SUMMARY OF THE INVENTION

The present invention relates to a camshaft for the operation of valves of an internal-combustion engine including a device for hydraulic adjustment of a relative rotating position of the camshaft for influencing a timing of the valves. The device has a drive wheel for the camshaft, a cell wheel, and an impeller which, by way of radial vanes, is disposed within cells of the cell wheel and is able to carry out a relative motion. A locking arrangement, operative in a starting phase of the internal-combustion engine, is provided between the cell wheel and the impeller. The locking arrangement is formed by an axially spring-loaded, hydraulically operated piston, which is accommodated in one of the vanes of the impeller, and a corresponding receiving device for the piston, which is provided in a constructional unit consisting of the drive wheel and the cell wheel.

German Patent Document DE 39 37 644 A1 concerns a known camshaft of the type mentioned above. A locking arrangement is provided in this known camshaft. In the starting phase of the internal-combustion engine, the locking arrangement fixes the impeller relative to the cell wheel to avoid uncontrolled movements of the two wheels with respect to one another. Such uncontrolled movements, among other things, can cause disturbing sounds. The locking arrangement comprises a slidably movable locking sleeve arranged coaxially between the cell wheel and the impeller. The locking sleeve non-rotatably connects the above-mentioned wheels with one another in a first position and separates them from one another in a second position.

In German Patent Document DE 1 96 23 818 A1, a corresponding locking device is provided between a vane-type extension of an impeller and a cover of the cell wheel. The locking arrangement is provided with a spring-loaded axially movable piston. In the starting phase of the internal-combustion engine, this piston engages in a receiving device of the cover.

It is an object of this invention to improve a locking arrangement of a device for adjusting the relative rotating position of a camshaft such that it can easily be integrated in the device and functions well.

According to the invention, this object is achieved by providing a piston which has a locking section projecting into the receiving device and guided in one of the vanes of the device. An operating element with which the piston cooperates is provided. The piston is acted upon by a first pressure space, and the operating element is acted upon by a second pressure space. Additional characteristics and further developments of the invention are reflected in the claims.

The principal advantages achieved by the invention are that the piston and the operating element cooperating therewith, which can be acted upon from separate pressure spaces, ensure a reliable and immediate effect of the locking arrangement of the device for adjusting the relative rotating position of the camshaft. The operating element, constructed as a pin, and the piston can be integrated in a simple and spatially favorable manner in the vane of the impeller of the device. Furthermore, the piston and the pin are components which can be produced at acceptable expenditures and mounted easily.

The drawings illustrate an embodiment of the invention which will be described in detail.

DESCRIPTION OF THE PREFERRED EMBODIMENT

Figure 1:
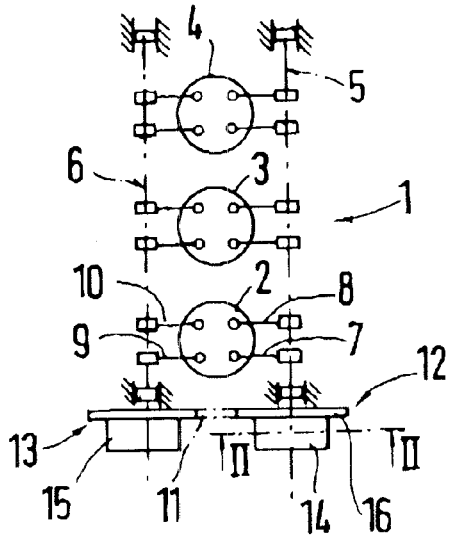
FIG. 1 is a top view of a schematically illustrated internal-combustion engine with camshafts for operating valves.
Figure 2:
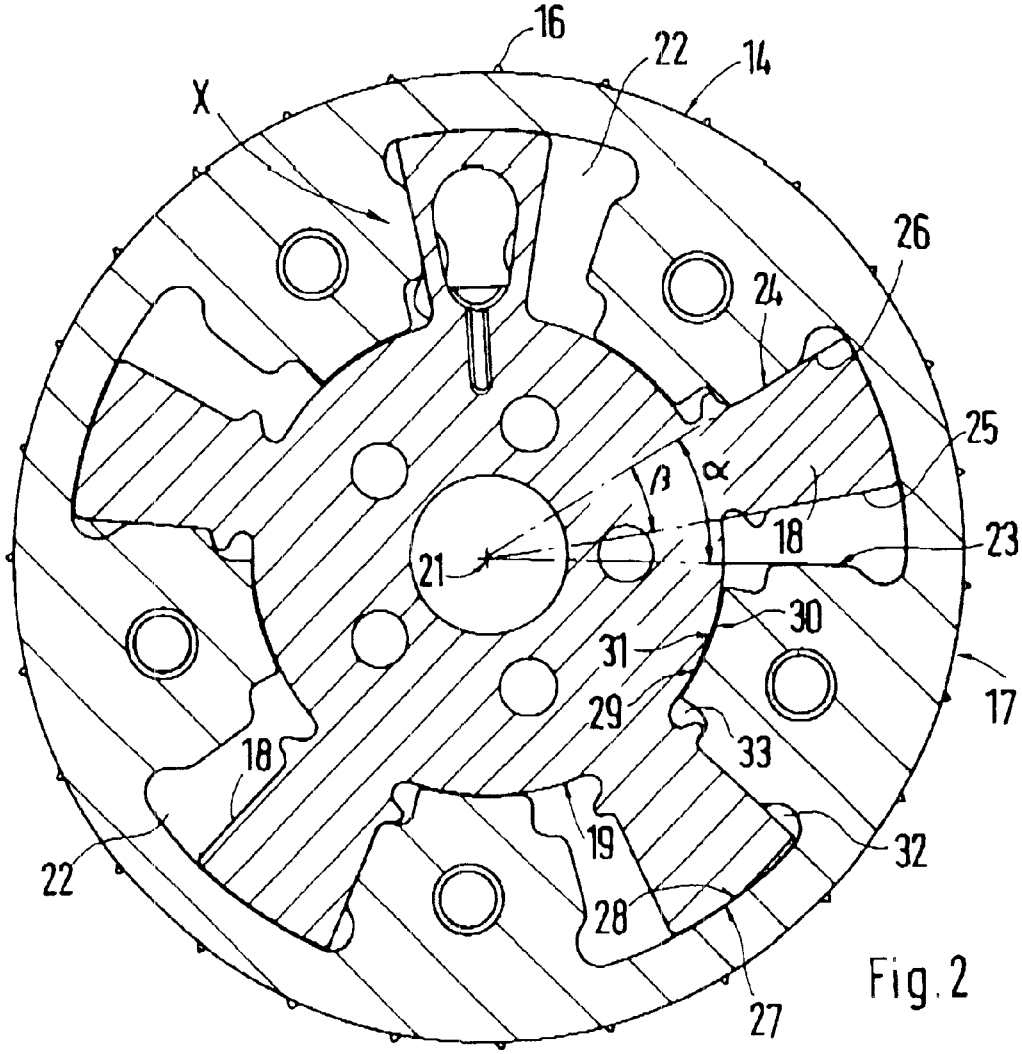
FIG. 2 is an enlarged sectional view along line II—II of FIG. 1.

An internal-combustion engine 1 of the Otto type is illustrated only schematically in FIG. 1 and comprises several cylinders 2, 3 and 4, two camshafts 5 and 6, and, for example, two inlet valves 7 and 8 and two outlet valves 9 and 10 per cylinder. The inlet valves 7, 8 and the outlet valves 9, 10 are accommodated, in a V-shape, in a cylinder head (not shown) of the internal-combustion engine 1. The two camshafts 5, 6 are connected with one another by way of an endless drive 11. The endless drive may be a belt, a chain or the like, and winds around corresponding drive wheels. The endless drive 11 is operative adjacent to faces 12, 13 of the above-mentioned camshafts. Devices 14, 15 for hydraulically adjusting the relative rotating position of these camshafts are coaxially connected to the faces 12, 13 of the camshafts 5, 6. Each device such as the device 14 is constructed as a vane cell pump. The timing of the valves 7, 8 is influenced, specifically in order to optimize the operation of the internal-combustion engine, among other things, with respect to the emission of exhaust gas.

The device 14 has a circular-cylindrical configuration and constructionally corresponds to the device 15. The device 14 comprises a drive wheel 16 constructed as a chain wheel for the camshaft 5, a cell wheel 17, and an impeller 19 equipped with radial vanes 18. The drive wheel 16, the cell wheel 17 and the impeller 19 are arranged coaxially with respect to the camshaft 5. The drive wheel 16 and the cell wheel 17 form a firmly mutually connected constructional unit 20. In contrast, the impeller 19, which can be swivelled about an axis of rotation 21, is housed by the vanes 18 in chamber-type cells 22 of the cell wheel 17. A total of five cells per device is provided. Each cell 22 is equipped with a first stop face 23 and a second stop face 24 for corresponding first and second stop faces 25, 26 of the vane 18. All stop faces 23, 24 and 25, 26 extend radially with respect to the axis of rotation 21, but the angle $\alpha$, which is enclosed by the stop faces 23, 24, is larger than the corresponding angle $\beta$ of the stop faces 25, 26 of the vane 18.

The cell 22 is also bounded by a circular surface 27. A circular surface 28 of the vane 18 extends toward the circular surface 27. Both circular surfaces 27 and 28 act as sealing surfaces. At reference number 29, circular surfaces 30, 31, forming comparable sealing surfaces, are provided between the impeller 19 and the cell wheel 17. Adjacent to the circular surfaces 27 and 30, the contact surfaces 23, 24 are provided with chamber-shaped recesses 32, 33 and 34, 35 by way of which hydraulic medium is admitted for acting upon the stop faces 25, 26 of the vane 18 of the impeller 19.

In the starting phase of the internal-combustion engine 1, the impeller 19 is fixed on the constructional unit 20 formed by the drive wheel 16 and the cell wheel 17, for the purpose of which a locking arrangement 36 is provided. The locking arrangement 36 comprises a piston 37 which can be displaced in a guide bore 38 of the vane 18 of the impeller 19 in the axial direction of the axis of rotation 21. By way of a locking section 39, the piston cooperates with a corresponding receiving device 40 in a hub body 41 of the constructional unit 20. The piston 37, which is made in one piece with the locking section 39, is acted upon from a first pressure duct 42 which is connected to a first pressure space 43. An operating element 44, which is operated by way of a second pressure duct 45, is operatively connected with the piston 37. The second pressure duct 45 is connected with a second pressure space 46. Both pressure spaces 43 and 46, which are separated from one another, are connected to the hydraulic system of the device 14.

Figure 3:
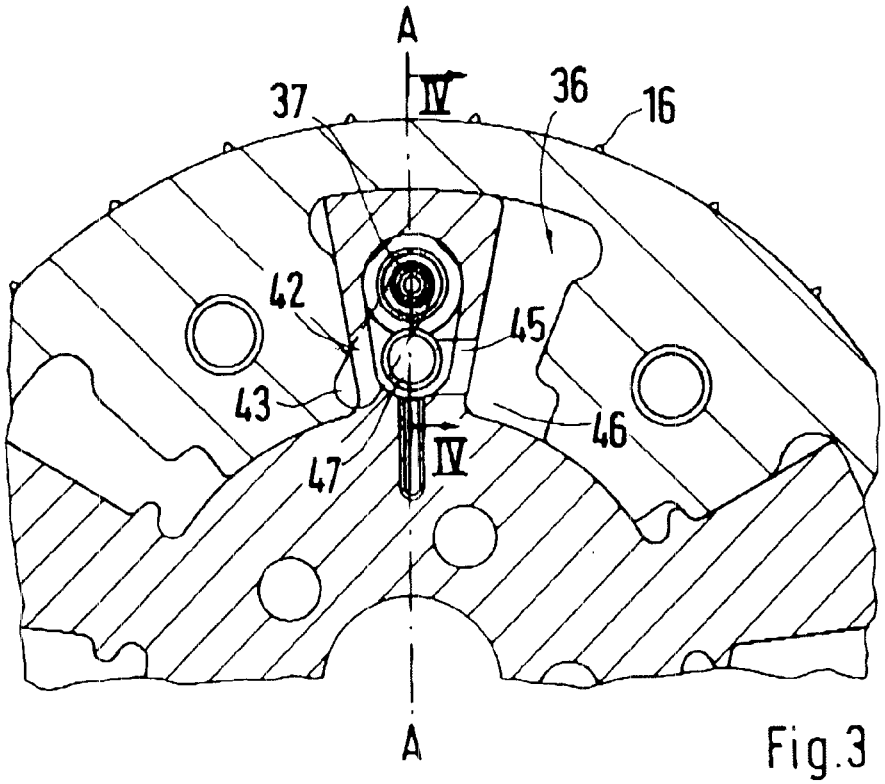
FIG. 3 is an enlarged view of a detail X of FIG. 2.
Figure 4:
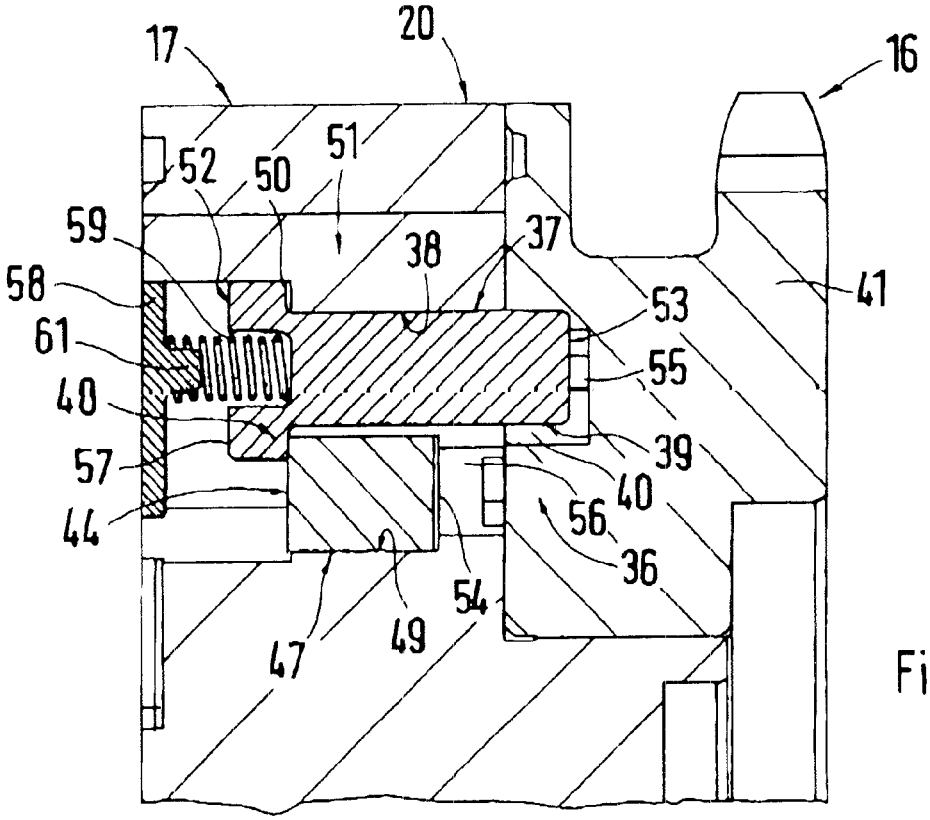
FIG. 4 is a sectional view along line IV—IV of FIG. 3.

The operating element 44 is formed by a pin 47, shown in FIG. 4, which is guided to a stop 48 of the piston 37. The pin 47 is arranged in a guide bore 49 and extends parallel to the piston 37. The pin is supported on a ring surface 50 which represents the stop 48 and which is provided on a piston head 52 on a side 51 facing away from the locking section 39. The locking section 39 guided in the guide bore 38 has a diameter which is smaller than the diameter of the piston head 52. The guide bores 38 and 49 of the piston 37 and of the pin 47, respectively, extend at a distance from one another which is as small as possible. As FIG. 3 shows, the guide bores are situated in a common radial plane A—A.

The piston 37 and the pin 47 are connected by faces 53 and 54 to pressure chambers 55 and 56 which are situated away from the ring surface 50. The pressure chamber 55 is connected with the first pressure duct 42. The pressure chamber 56 is connected with the second pressure duct 45. Furthermore, a pressure spring 59 is operative between a free side 57 of the piston head 52 and a supporting part 58 of the vane 18. The pressure spring 59 rests in sections in a recess 60 of the piston head 52 and surrounds a journal 61 of the supporting part 58, which is constructed as a spring plate.

When the internal-combustion engine is not in operation, its hydraulic system, including the device 14, is without pressure. As a result, the pressure spring 59 holds the locking section 39 of the piston 37 in position in the receiving device 40, and a relative movement of the impeller 19 in the cell wheel for adjustment of the camshaft 5 cannot take place. This condition is at first maintained in the starting phase of the internal-combustion engine 1 with a defined pressure level in the hydraulic system. After the above-mentioned pressure level has been exceeded, the piston 37 and the pin 47 are acted upon by hydraulic medium by way of the faces 53 and 54, respectively, and the locking section 39 is led out of the receiving device 40 against the effect of the pressure spring 59. The impeller 19, or rather the camshaft 5, can now be adjusted as a function of parameters (rotational speed, load) of the internal-combustion engine.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A camshaft for operation of valves of an internal-combustion engine, comprising:

a device for hydraulic adjustment of a relative rotating position of the camshaft for influencing a timing of the valves, said device having a drive wheel for the camshaft, a cell wheel, and an impeller which, by way of radial vanes, is disposed within cells of the cell wheel and is able to carry out a relative motion, a locking arrangement, which is operative in a starting phase of the internal-combustion engine, provided between the cell wheel and the impeller, said locking arrangement being formed by an axially spring-loaded, hydraulically operated piston which is accommodated in one of the vanes of the impeller and a corresponding receiving device for the piston which is provided in a constructional unit consisting of the drive wheel and the cell wheel, the piston having a locking section which projects into the receiving device and being guided in the one of the vanes of the device, and an operating element with which the piston cooperates, the piston being acted upon by a first pressure space and the operating element being acted upon by a second pressure space to move the locking section out of the receiving device after a starting phase of the internal combustion engine.

2. A camshaft for operation of valves of an internal-combustion engine, comprising:

a device for hydraulic adjustment of a relative rotating position of the camshaft for influencing a timing of the valves, said device having a drive wheel for the camshaft, a cell wheel, and an impeller which, by way of radial vanes, is disposed within cells of the cell wheel and is able to carry out a relative motion, a locking arrangement, which is operative in a starting phase of the internal-combustion engine, provided between the cell wheel and the impeller, said locking arrangement being formed by an axially spring-loaded, hydraulically operated piston which is accommodated in one of the vanes of the impeller and a corresponding receiving device for the piston which is provided in a constructional unit consisting of the drive wheel and the cell wheel, the piston having a locking section which projects into the receiving device and being guided in the one of the vanes of the device, and an operating element with which the piston cooperates, the piston being acted upon by a first pressure space and the operating element being acted upon by a second pressure space, wherein the operating element is formed by a pin which is guided onto a stop of the piston.

3. The camshaft according to claim 2, wherein the pin extends parallel to the piston, and the stop of the piston is a ring surface which, on a side facing away from the locking section, is formed by a piston head.

4. The camshaft according to claim 3, wherein the piston and the pin are arranged in guide bores of the one of the vanes which are situated in a common radial plane of the device.

5. The camshaft according to claim 4, and further comprising a pressure spring operative between a free side of the piston head and a supporting part of the one of the vanes.

6. The camshaft according to claim 5, wherein the pressure spring rests in a recess of the piston head and surrounds a journal of the supporting part constructed as a spring plate.

7. The camshaft according to claim 3, wherein the piston and the pin are connected by faces on pressure chambers which are both situated away from the ring surface.

8. The camshaft according to claim 7, and further comprising a pressure spring operative between a free side of the piston head and a supporting part of the one of the vanes.

9. The camshaft according to claim 8, wherein the pressure spring rests in a recess of the piston head and surrounds a journal of the supporting part constructed as a spring plate.

10. The camshaft according to claim 3, and further comprising a pressure spring operative between a free side of the piston head and a supporting part of the one of the vanes.

11. The camshaft according to claim 10, wherein the pressure spring rests in a recess of the piston head and surrounds a journal of the supporting part constructed as a spring plate.

* * * * *